US007445445B2

(12) United States Patent
Eroglu et al.

(10) Patent No.: US 7,445,445 B2
(45) Date of Patent: Nov. 4, 2008

(54) BURNER HAVING A BURNER LANCE AND STAGED FUEL INJECTION

(75) Inventors: Adnan Eroglu, Untersiggenthal (CH); Peter Flohr, Birmenstorf (CH); Peter Stuber, Zurich (CH); Martin Zajadatz, Dangstetten (DE); Christian Oliver Paschereit, Berlin (DE)

(73) Assignee: ALSTOM Technology Ltd., Baden (CH)

( * ) Notice: Subject to any disclaimer, the term of this patent is extended or adjusted under 35 U.S.C. 154(b) by 82 days.

(21) Appl. No.: 10/931,052

(22) Filed: Sep. 1, 2004
(Under 37 CFR 1.47)

(65) Prior Publication Data

US 2005/0106522 A1 May 19, 2005

(30) Foreign Application Priority Data

Sep. 1, 2003 (CH) ..... 1493/03

(51) Int. Cl.
*F23D 14/46* (2006.01)

(52) U.S. Cl. ..... 431/350; 431/351

(58) Field of Classification Search ..... 431/351, 431/352, 354, 350; 60/737, 738
See application file for complete search history.

(56) References Cited

U.S. PATENT DOCUMENTS 5,118,283 A * 6/1992 Sattelmayer ..... 431/9
5,127,821 A 7/1992 Keller
5,482,457 A 1/1996 Aigner et al.
5,833,451 A 11/1998 McMillan
6,918,256 B2 * 7/2005 Gutmark et al. ..... 60/737

(Continued)

FOREIGN PATENT DOCUMENTS

EP 0 078 629 B1 4/1985

(Continued)

OTHER PUBLICATIONS

Search Report from EP 04 10 4099 (Dec. 27, 2004).

(Continued)

*Primary Examiner*—Alfred Basichas
(74) *Attorney, Agent, or Firm*—Cermak Kenealy & Vaidya LLP; Adam J. Cermak

(57) ABSTRACT

A burner includes a swirl generator (3) for a combustion airflow, has a conical swirl chamber (2) and a device for admitting fuel into the combustion airflow, wherein the swirl generator (3) incorporates combustion air inlet openings for the combustion airflow tangentially entering into the conical swirl chamber (2), and wherein the device for admitting fuel into the combustion airflow includes a first fuel feeding device having a first group (4) of fuel outlet openings substantially disposed in the direction of the burner axis for a first premix fuel quantity. The burner incorporates at least one second fuel feeding device having at least one second group (5) of fuel outlet openings that are substantially disposed in the direction of the burner axis for a second premix fuel quantity, which can be supplied with fuel independently from the first fuel feeding device, a burner lance (6) along a burner axis (A) projects from the side of the swirl chamber (2) with the smallest swirl chamber cross section into the swirl chamber (2), and the device for supplying fuel into the combustion airflow additionally incorporates at least one fuel outlet opening (8) within the burner lance (6), through which fuel is dischargeable along the burner axis.

13 Claims, 1 Drawing Sheet

U.S. PATENT DOCUMENTS

| | | | | |
|---|---|---|---|---|
| 7,189,073 | B2 * | 3/2007 | Pennell et al. | 431/353 |
| 2003/0152880 | A1 * | 8/2003 | Eroglu et al. | 431/8 |
| 2004/0053181 | A1 * | 3/2004 | Pennell et al. | 431/350 |

FOREIGN PATENT DOCUMENTS

| | | | |
|---|---|---|---|
| EP | 0 321 809 | B1 | 5/1991 |
| EP | 0 918 191 | B1 | 7/2003 |
| WO | 01/96785 | A1 | 12/2001 |
| WO | 02/29318 | A1 | 4/2002 |
| WO | 02/052201 | A1 | 7/2002 |

OTHER PUBLICATIONS

Search Report from CH 1493/03 (Dec. 4, 2003).

* cited by examiner

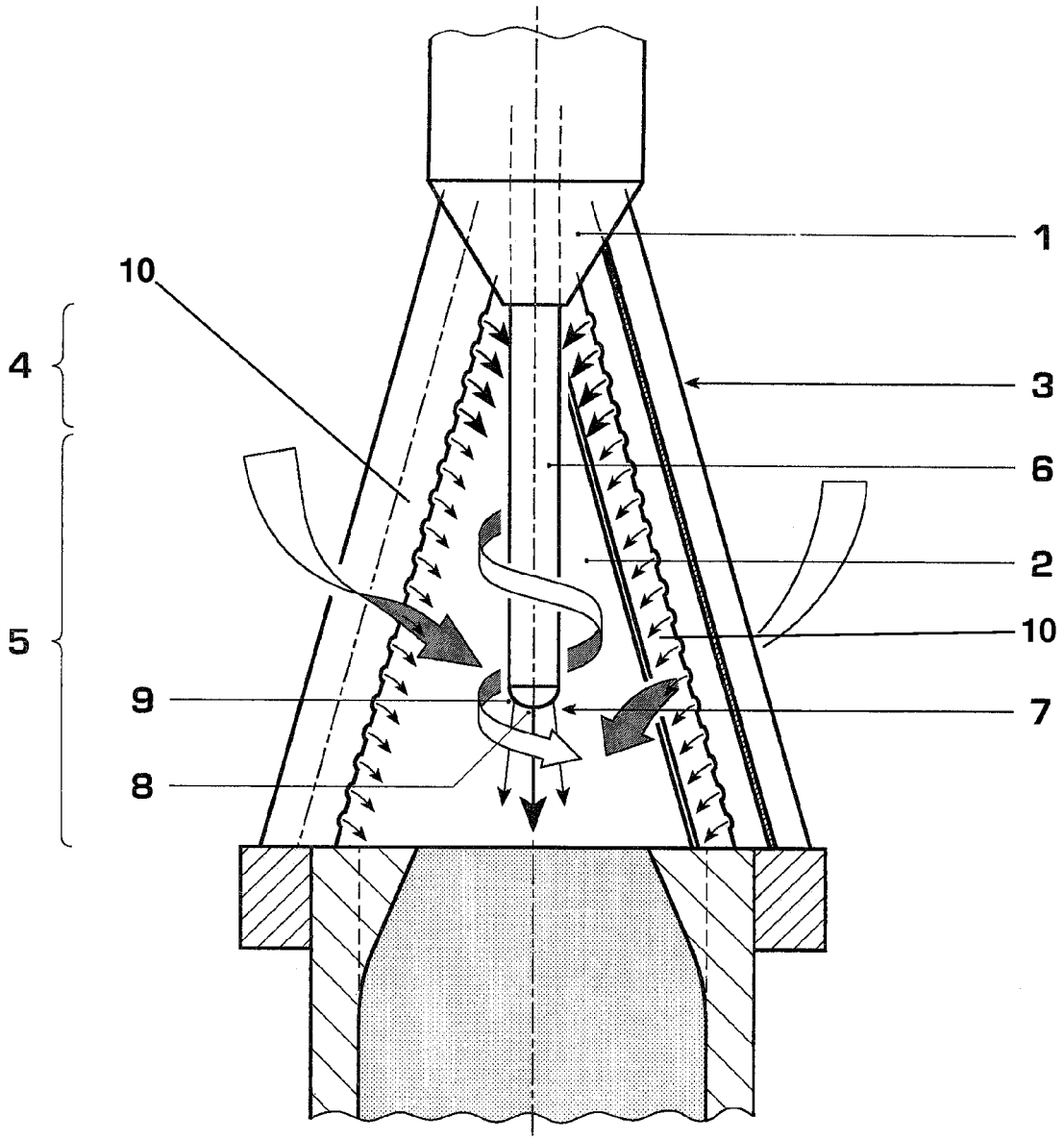
1
10
4
3
6
2
5
10
9
7
8

BURNER HAVING A BURNER LANCE AND STAGED FUEL INJECTION

This application claims priority under 35 U.S.C. § 119 to Swiss application number 01493/03, filed 1 Sep. 2003, the entirety of which is incorporated by reference herein.

BACKGROUND OF THE INVENTION

1. Field of the Invention

The invention relates to a burner, including a swirl generator for a combustion airflow, having a conical swirl chamber and means for admitting fuel into the combustion airflow, wherein the swirl generator incorporates combustion air inlet openings for the combustion airflow tangentially entering into the conical swirl chamber, and wherein the means for admitting fuel into the combustion airflow includes a first fuel feeding means having a first group of fuel outlet openings substantially disposed in the direction of the burner axis for a first premix fuel quantity.

2. Brief Description of the Related Art

A conical burner having a plurality of shells, a so-called double-cone burner, is known from EP 0 321 809 B1. The conical swirl generator, which is composed of a plurality of shells, generates a closed swirling flow in the cone head, which, due to the increasing swirl along the conically widening swirl chamber, becomes unstable and transitions into an annular swirling flow with a backflow in its core. The shells of the swirl generator are assembled in such a way that tangential air inlet slots for combustion air are formed along the burner axis. Along the inlet flow edge of the conical shells that is created in this manner, inlets for the pre-mix gas, i.e., the gaseous fuel, are provided, which incorporate outlet openings for the premix gas that are distributed in the direction of the burner axis.

The gas is injected through the outlet openings or bores at an angle to the air inlet slot. This injection process, in combination with the swirl of the combustion-air-fuel-gas generated in the swirl chamber, results in a good intermixing of the fuel gas or premix gas with the combustion air. In premix burners of this type a good intermixing is the precondition for low $NO_x$ values during the combustion process.

To further improve a burner of this type, a burner for a heat generator is known from EP 0 780 629 A2, which incorporates an additional mixing path adjoining the swirl generator, for an additional intermixing of fuel and combustion air. This mixing path may be implemented, for example, in the form of a downstream tube, into which the flow emerging from the swirl generator is transferred without any significant flow losses. With the aid of this additional mixing path the degree of intermixing can be increased further and the pollutant emissions reduced accordingly.

While it is true that the above burner systems, which operate based on the principle of the lean premix combustion, have low pollutant emissions, they additionally also have a noticeably limited stability range. Especially when low-caloric fuels, namely so-called MBTU and LBTU fuel gases are used, which flow through the fuel outlet openings along the combustion air inlet openings into the swirl chamber, it has been shown that the gas pre-pressure increases significantly, causing the degree of efficiency of a gas turbine system that is combined with a burner to be significantly reduced. Additionally, the flame speed increases significantly, bringing with it the risk of a flashback into the burner. In a constellation of this type the burner transitions into a so-called diffusion mode, which inevitably leads to high $NO_x$ emissions. In addition to the risk of a flashback into the mixing zone of the burner and lift-off and extinguishing of the premix flame, so-called thermo-acoustic oscillations result in a noticeably reduced burner performance.

One possible measure for countering the risk of a flashback provides for a fuel injection that is provided as far downstream as possible along the premixing path, causing the mixing path for the formation of a completely intermixed fuel-air mixture to be significantly shortened.

To improve the degree of intermixing between fuel and air, EP 0 918 191 A1 provides for a fuel injection that is offset back in the flow direction through the combustion air inlet openings, so that a partial intermixing occurs between the fuel and combustion air before they flow into the remaining interior space of the swirl generator. However, in order to ensure the formation of a stable flame front within the combustion chamber, extensive and structurally complicated flow-relevant measures must be taken within the burner structure. Additionally, it has been shown that especially the performance of a burner with respect to the flame stability, its emission values and the occurrence of thermo-acoustic pulsations are subject to much greater instabilities in burners for the operation of gas turbine systems with medium and small output than in the case of burners that are designed for high-efficiency gas turbine systems.

SUMMARY OF THE INVENTION

The invention aims at improving a burner of the above type, in such a way that the performance of the burner shall be implemented stable within the largest possible operating range, i.e., the burner is to display the most uniform combustion stability possible irrespective of its load at a given time. Additionally, the burner should also be operable with different types—or qualities—of fuel and in a stable manner, especially at a low burner output. The inventive measures shall be simple and cost effective to implement and additionally offer the option of retrofitting existing burners. Within the above required large operating range, the burner shall have a minimized pollutant emission, as well as a maximum degree of efficiency under formation of a stable flame.

The inventive burner according to the principles of the present invention is characterized by the combination of two measures. The burner accordingly incorporates at least one second fuel feeding means that has at least one second group of fuel outlet openings substantially disposed in the direction of the burner axis for a second premix fuel amount, which can be supplied with fuel independently from the first fuel feeding means. In this manner it is possible to individually adjust the fuel supply together with the combustion air inflow into the conical swirl chamber in at least two separate chamber areas along the burner axis within the swirl chamber and thus, in dependence upon the given burner load at the time, create individual fuel-air mixtures within the swirl chamber.

Additionally, a burner lance projects into the swirl chamber along one burner axis from the side of the swirl chamber that has the smallest swirl chamber cross section, and incorporates at least one fuel outlet opening within the burner lance through which fuel, preferably liquid fuel, can be discharged along the burner axis. Due to its preferably round outer contour, the burner lance, which projects into the swirl chamber over at least 50% of the axial extension of the swirl chamber, is able to stabilize the flow-dynamically forming swirling flow within the swirl chamber on one hand, ultimately also resulting in a stabilization of the flame front within the combustion chamber, and the fuel outlet opening, on the other hand, which is preferably oriented along the longitudinal axis of the burner, permits an additional admission of fuel into the swirl chamber, which intermixes with the combustion air that has been supplied via the tangential combustion air inlet openings along the swirl generator, and contributes to the stable formation of a flame front forming downstream in the combustion chamber.

An advantage of the burner that is implemented according to the principles of the present invention can be seen in the multi-stage fuel admission into the swirl chamber, whereby the burner performance in dependence upon the burner load can be adjusted with a very precise metering. At the same time the presence of the burner lance within the swirl chamber, which represents a kind of flow body or flow-modifying body for the fuel-air mixture forming along the burner axis within the swirl chamber, causes the degree of thermo-acoustic pulsations that commonly occur in the course of the combustion to be significantly reduced. This reduces not only the danger of a flashback into the mixing area of the premix burner, the flame that is aerodynamically stabilized by the burner lance also contributes to a complete combustion of the fuel portion in the fuel-air mixture, whereby, lastly, dangerous emissions can be significantly reduced.

The inventive integration of the burner lance into a premix burner that incorporates at least two stages permits a burner operation with any type of fuel. The burner lance that is provided within the swirl chamber permits the discharge of liquid fuel, preferably in an axial direction in the direction of the burner axis.

In a preferred embodiment, the burner lance is provided on its burner lance tip with the fuel outlet opening, which is encompassed by an annular opening through which the combustion air can be supplied along the burner axis, so that the fuel discharge through the fuel outlet opening is enveloped in a conical shape by the combustion air, creating a centered admission of a liquid-fuel-air mixture along the swirl chamber, in addition to the spirally expanding gaseous fuel-air mixture along the burner axis.

As mentioned above, the conically shaped swirl generator has along its combustion air inlet openings at least two groups of fuel outlet openings through which individually selectable premix fuel quantities can be fed into the swirl chamber in each case. In this manner it becomes possible to attain individual mix distributions and mix qualities while taking into consideration different combustion boundary conditions. Additionally, it is also possible with this design to balance different wobble numbers, for example in such a way that a certain volume flow of fuel is discharged via the first fuel feeding means and the remainder of the volume flow that is required for a certain efficiency range is discharged via the second fuel feeding means.

The axial and radial fuel distribution within the burner can be favorably influenced by means of a suitable placement of the second fuel feeding means incorporating the corresponding second group of fuel outlet openings relative to the first fuel feeding means incorporating the first group of fuel outlet openings.

In a preferred embodiment of the burner, wherein third and more fuel feeding means can also be supplied independently from one another with premix fuel, preferably gaseous premix fuel, an even more precise graduated adaptation of the mix distribution and mix quality can be made to various boundary conditions.

The inventive burner is, of course, not limited to only two fuel feeding means with corresponding fuel outlet openings disposed in the direction of the burner axis. On the contrary, the inventive burner concept also includes three, four and multi-staged fuel feeding means with corresponding fuel outlet openings, which can be supplied separately and from one another in each case with gaseous fuel for a fuel discharge into the swirl chamber for the formation of a fuel-air mixture to expand along the burner axis.

The groups of the fuel outlet openings that are essentially disposed in the direction of the burner axis, which are individually supplied via fuel feeding means with gaseous fuel in each case, are disposed in series behind one another in the direction of the burner axis in the corresponding example embodiments, or implemented accordingly partially overlapping at least in the burner axis. There are, in principle, no design-related limitations to the special grouped placements of fuel outlet openings along the burner axis in the region of the combustion air inlet openings, If the burner is operated in a preferred manner within the framework of a heat generator, such as in a gas turbine, the entire fuel may be supplied during a start-up phase of the gas turbine via the first fuel feeding means. During operation of the heat generator under full load the fuel may be distributed, for example, via a first as well as via one or more second fuel feeding means.

Depending on the desired options for influencing the premix, the second fuel outlet openings of the second fuel feeding means may have a different mutual spacing or different flow cross sections compared to the first fuel outlet openings. Especially with a placement wherein at least one second fuel feeding means is provided immediately adjacent to a first fuel feeding means, the given fuel outlet openings may also have an identical mutual spacing but be disposed offset from one another. This results in a more even injection of the premix fuel into the swirl chamber. Additionally, the first fuel outlet openings may be disposed over the entire axial expansion of the combustion air inlet openings but the second fuel outlet openings may be disposed only in a certain axial partial area. In the same manner it is also possible to provide the first fuel outlet openings in only a first axial partial area and the second fuel outlet openings in only a second axial partial area adjoining the first partial area—or vice versa.

For a mutually independent supply of the first and second fuel feeding means with the premix fuel, they are provided with different hook-ups. Additionally, means are preferably provided for a mutually independent regulation or control of the premix fuel supply to the first and second fuel feeding means. The different supply may be controlled, for example, by means of a suitable control valve.

BRIEF DESCRIPTION OF THE DRAWINGS

The invention will be described below, without limiting the general inventive idea, with the aid of one single exemplary embodiment and reference to the single FIGURE.

DETAILED DESCRIPTION OF THE PREFERRED EMBODIMENTS

The FIGURE shows a longitudinal section though a premix burner that is shown highly schematicized, with a burner lance 6. The premix burner incorporates a swirl chamber 2 that conically widens starting from the burner head 1, said swirl chamber being radially encompassed by a conical swirl generator 3 consisting in each case of at least two premix burner shells that encompass at least two combustion air inlet openings or slots 10 for a combustion air flow that tangentially enters into the conical swirl chamber 2. A burner of this type is described in detail in EP 0 321 809 B1, and that printed publication is an integral component of the present description. Provided along the combustion air inlet openings, which are not explicitly shown here, is a first group 4 of fuel outlet openings substantially disposed in the direction of the burner axis A, which are supplied with preferably gaseous fuel via a first fuel feeding means, which is not shown. Adjoining axially downstream from the first group 4 of fuel outlet openings is a second group 5 of fuel outlet openings, which can be supplied separately via a second fuel feeding means with a second premix fuel quantity. The burner set-up shown in the FIGURE represents a so-called two-stage premix burner, wherein the number of stages depends upon the number of separate groups of burner outlet openings to be separately supplied with gaseous fuel. Embodiments in which thee or more groups of fuel outlet openings are disposed along the combustion air inlet openings are conceivable, of course.

Staged premix burners of this type permit, in dependence upon the given mode of operation, i.e., be it startup, partial load or full load conditions, an optimized fuel supply into the swirl chamber 2, whereby an optimized combustion is ensured. For lean premix conditions, for example during the startup phase of the burner, gaseous fuel is fed into the swirl chamber via the first group 4 of fuel outlet openings. Once the performance of the burner approaches partial-load operation, the fuel supply via the first stage of the fuel outlet openings 4 is supplemented with an independently regulated second fuel supply via the second stage of the fuel outlet openings 5. During full-load operation, a fuel supply exclusively via the second stage of the fuel outlet openings 5 is suitable. The burner lance 6, which centrally projects from the direction of the burner head 1 into the swirl chamber 2, due to its aerodynamically shaped round outer contour, serves to stabilize the swirling fuel-air flow forming within the swirl chamber 2, which, according to the longitudinal section drawing, expands in an axial direction to the right into the adjoining combustion chamber, which is not shown. With the aid of the aerodynamically stabilizing effect of the burner lance 6 on the forming swirling fuel-air flow, a spatially stable flame front is supported within the combustion chamber. The customarily occurring thermo-acoustic oscillations are also considerably reduced by the burner lance.

Additionally provided on the burner tip 7 of the burner lance 6 is at least one additional fuel outlet opening 8, through which liquid fuel is discharged in an axial direction to the burner axis A. For an effective intermixing with air of the liquid fuel exiting from the fuel outlet opening 8, a preferably annular air outlet opening 9 is provided around the outlet opening 8 on the burner tip 7, through which outlet opening the liquid fuel discharge into the combustion chamber is surrounded by a preferably conically expanding swirling airflow. The central liquid fuel discharge through the burner lance 6 into the swirl chamber 2 results in a central fuel enrichment within the fuel-air mixture that is expanding vortex-like, whereby the flame front that is forming within the combustion chamber (not shown) is additionally stabilized and the combustion temperature is increased.

The fuel supply, be it through the fuel outlet openings 4, 5 or 8, can be carried out in an individual mutually adapted manner depending on the performance of the burner.

The inventive burner concept, through its multiplicity of different, separately controllable fuel feeding means in the presence of an aerodynamically stabilizing burner lance, opens up a high degree of variability of control measures with respect to the type of fuel, quantity of fuel, as well as the spatial distribution of the fuel supply within the swirl generator.

In addition to the purely axially directed liquid fuel discharge from the burner lance, it is also possible, of course, to discharge liquid fuel into the swirl chamber 2 of the swirl generator 3 through fuel outlet openings, which are not shown, that are disposed radially to the burner lance.

LIST OF REFERENCE NUMERALS

1 Burner Head
2 Swirl Chamber
3 Swirl Generator
4 First Group of Fuel Outlet Openings
5 Second Group of Fuel Outlet Openings
6 Burner Lance
7 Burner Lance Tip
8 Fuel Outlet Opening
9 Air Outlet Opening on the Burner Lance Tip
10 air inlet slots While the invention has been described in detail with reference to preferred embodiments thereof, it will be apparent to one skilled in the art that various changes can be made, and equivalents employed, without departing from the scope of the invention. Each of the aforementioned documents is incorporated by reference herein in its entirety.

What is claimed is:

1. A burner comprising:

a swirl generator for a combustion airflow having a conical swirl chamber and means for admitting fuel into the combustion airflow, the swirl generator including combustion air inlet openings for the combustion airflow tangentially entering into the conical swirl chamber, and wherein the means for admitting fuel into the combustion airflow comprises a first fuel feeding means, a second fuel feeding means, and a series of fuel outlet openings substantially disposed in the direction of the burner axis along the combustion air inlet openings configured and arranged to inject a fuel into the stream of air when entering the swirl chamber though said air inlet openings, the series of fuel outlet openings being subdivided at least into a first group and a second group of fuel outlet openings, said first group of outlet openings being supplied with a first fuel by the first fuel feeding means, and said second group of fuel outlet openings being supplied with a second fuel by the second fuel feeding means independently from the first fuel feeding means;

a burner lance along a burner axis with a round outer contour projecting from the side of the swirl chamber with the smallest swirl chamber cross section into the swirl chamber over at least 50% of the axial length of the swirl chamber; and wherein the means for admitting fuel into the combustion airflow further comprises at least one fuel outlet opening within the burner lance though which liquid fuel is dischargeable along the burner axis.

2. A burner according to claim 1, wherein the fuel outlet openings of at least one of the two groups of fuel outlet openings are distributed over the entire axial extent of the combustion air inlet openings and the fuel outlet openings of the other group of the two groups of fuel outlet openings are distributed over an axial partial area of the combustion air inlet openings.

3. A burner according to claim 1, wherein the fuel outlet openings of at least one of the two groups of fuel outlet openings are distributed on a first axial partial area of the combustion air inlet openings and the fuel outlet openings of the other group of the two groups of fuel outlet openings are distributed on additional axial partial areas of the combustion air inlet openings.

4. A burner according to claim 3, wherein said axial partial areas do not overlap.

5. A burner according to claim 3, wherein at least two of said axial partial areas overlap at least partially.

6. A burner according to claim 1, wherein the fuel outlet openings of the groups of fuel outlet openings have different flow cross sections.

7. A burner according to claim 1, wherein at least one of the two groups of fuel outlet openings are disposed in the region of at least one of the combustion air inlet openings.

8. A burner according to claim 1, wherein the combustion air inlet openings comprise tangential inlet openings that substantially extend in the direction of the burner axis.

9. A burner according to claim 8, wherein the combustion air inlet openings comprise inlet slots, and the two groups of fuel outlet openings are disposed along said inlet slots.

10. A burner according to claim 1, wherein the burner lance freely projects into the swirl chamber and includes a burner lance tip having a rounded contour.

11. A burner according to claim 10, wherein the fuel outlet opening is located on the burner lance tip, though which fuel outlet opening fuel is dischargeable along the burner axis.

12. A burner according to claim 11, further comprising:

an annular opening or opening configuration on the burner lance tip that encompasses the fuel outlet openings and though which the combustion air can be discharged along the burner axis so that the fuel discharge though the fuel outlet opening is surrounded by the combustion air.

13. A burner according to claim 1, wherein the burner lance comprises a round exterior cross section contour that aerodynamically stabilizes the combustion airflow within the swirl chamber.

* * * * *